United States Patent [19]

Possell

[11] Patent Number: 4,534,699

[45] Date of Patent: Aug. 13, 1985

[54] COAL FIRED TURBINE

[76] Inventor: Clarence P. Possell, 19867 Cajon Blvd., San Bernadino, Calif. 92407

[21] Appl. No.: 506,785

[22] Filed: Jun. 22, 1983

[51] Int. Cl.[3] ..... F01D 1/36

[52] U.S. Cl. ..... 415/42; 415/90

[58] Field of Search ..... 415/45, 90, 202, 214, 415/42, 43; 60/39.464

[56] References Cited

U.S. PATENT DOCUMENTS

| | | | |
|---|---|---|---|
| 1,445,310 | 2/1923 | Hall | 415/90 |
| 4,201,512 | 5/1980 | Marynowski et al. | 415/90 |
| 4,218,177 | 8/1980 | Robel | 415/90 |
| 4,232,992 | 11/1980 | Possell | 415/90 |
| 4,245,463 | 1/1981 | Mansson et al. | 60/39.464 |

OTHER PUBLICATIONS

Gas Turbine International, "*Ceramics–Key to the Hot Turbine*", (Jan.–Feb. 1973).

*Primary Examiner*—Robert E. Garrett
*Assistant Examiner*—Joseph M. Pitko
*Attorney, Agent, or Firm*—William C. Babcock

[57] ABSTRACT

A turbine for operating on pressurized gaseous products of combustion resulting from the burning of coal and which gaseous products contain fly ash. The turbine includes a housing that supports a power take off shaft on which a rotor is mounted that includes a central circular plate that supports an equal number of first and second ring shaped discs on opposite sides thereof, with the first discs being of substantially greater diameter than the second discs. The second disc cooperates to define a number of first inwardly extending passages therebetween, and the second ring shaped discs cooperate with the first ring shaped discs to form second passages therebetween of substantially less width than the first passages. The pressurized gaseous products of combustion are discharged substantially tangentially onto the rotor to flow inwardly in a spiral path through the first passages to impart a first torque to the first ring shaped discs due to the frictional boundary layer drag to which the portions of the first ring shaped discs that define the first passages are subjected. A second torque is impacted to the rotor to augment the first torque as the gaseous products of combustion flow through the second passages at least in part at a velocity greater than that at which it exited from the first passages due to the narrower width of the second passages and in so doing imparting additional boundary layer drag to the rotor. The increase in velocity results in increased torque output and overall efficiency in operation. No appreciable side thrust is exerted on the power take off shaft due to there being a substantially equal flow of pressurized gaseous products of combustion on each side of the circular rotor plate. The first and second passages are of sufficient width that entrained particles of fly ash simply discharge therethrough. The discs are preferably of a high temperature resisting ceramic to permit operation of the turbine at a temperature greater than 2000° F.

7 Claims, 6 Drawing Figures

COAL FIRED TURBINE

DESCRIPTION OF THE PRIOR ART

When a fossil fuel such as coal is burned in a fluidized bed at an optimum fuel air ratio, a pressurized stream of gaseous products of combustion is obtained that can have a temperature in excess of 3,000° F., and this stream also containing entrained fly ash. It has been known for many years in the gas turbine art that if the turbine inlet pressure is raised 350° F. the horse power output of the turbine will be doubled and the turbine will have the efficiency thereof increased by approximately ten percent.

However, these advantages have not been attained even though the source of a stream of pressurized gaseous products of combustion is available at a temperature of 3,000° F., for when a temperature in excess of 2,000° F. is used as a source of power the materials defining the rotor of the turbine tends to fail for lack of strength at the high temperature.

As a result a pressurized stream of gaseous products of combustion from a fluidized bed of coal has to be cooled to 2,000° F. by adding excess cold air to the mixture and in so doing lowering the efficiency of the turbine. Also turbines operating on pressurized streams of gaseous products of combustion containing fly ash tend to have relatively short operating lives due to the fly ash impinging on the blades of the turbine and causing it to fail and operate at a low efficiency.

Various methods have been devised in the past in an attempt to increase the temperature above 2,000° F. at which a turbine may operate by providing internal cooling of the blades, but this simply renders the blades more expensive, and to the point that they are not economic for normal industrial use, although such methods may be employed by the military where cost is not a limitation.

A major object of the present invention is to provide a gas fired turbine that may be operated from a pressurized stream of gaseous products of combustion that contain fly ash and at a temperature of greater than 2,000° F. to increase both the power output and efficiency of the turbine without damage of the latter, and also provide a turbine that operates at a substantially constant speed at loads of varying magnitude.

Another object of the invention is to provide a turbine that is particularly adapted for driving a rotating electrical power generating unit at constant speed that has an alternating current output, and with the output being maintained at a predetermined number of cycles per second.

Yet another object of the invention is to furnish a turbine that is simple in structure, and quiet in operation, in that, the pressurized stream of gaseous products of combustion move through the turbine in the same direction as the rotor discs rotate, and fly ash entrained with the products of combustion flowing through the turbine without contacting or abrading the discs that comprise the rotor.

A still further object of the invention is to provide a turbine that is inherently self regulating as to speed, in that, when the centrifugal force imposed on the gaseous products of combustion due to the rotation of the discs equals the pressure ratio across the turbine, the gaseous products of combustion simply travel around in a circle in the housing of the turbine and the speed of the turbine levels off, which is in contrast to the situation when the load is removed from a bladed turbine wherein the turbine will tend to run away and the speed increase until there is an incipient failure of the turbine due to the centrifugal forces imposed on the rotor.

Yet another object of the invention is to provide a turbine system in which the speed of the turbine is precisely controlled by a closed loop servo controlled valve assembly that maintains the turbine precisely at 3,600 revolutions per minute which is the synchronous speed of a two pole A.C. alternator, and there being a potentiometer on the servo valve shaft which closes the loop and provides rapid response to the solid state control system.

These and other objects and advantages of the invention will become apparent from the following description of the structual details thereof.

SUMMARY OF THE INVENTION

The turbine of the present invention is particularly adapted to be powered by a pressurized stream of hot gaseous products of combustion resulting from the burning of coal in a fluidized bed or combustion can and which stream normally will contain fly ash. The turbine is of a type that includes a housing defined by first and second laterally spaced side walls and an end wall extending therebetween that has an inlet therein through which the hot pressurized stream product of combustion flow.

The housing provides a circular interior in which a number of overlapping, elongate, nozzle bodies are adjustably supported and inwardly spaced from the end wall to provide a ring shaped space therebetween. Each of the pair of nozzle bodies defines an outwardly disposed converging space, a throat, and a diverging space that are dimensionally adjustable to the particular characteristics of the pressurized stream of gaseous products of combustion derived from fluidized bed of coal.

The turbine has first and second ninety degree shaped tubular gaseous products of combustion discharge members extending outwardly from central openings in the first and second side wall, with the tubular members being of substantially greater transverse cross section than that of the gaseous products of combustion inlet, in order that there will be a minimum of back pressure on products of combustion discharging from the turbine. The tubular members support a pair of co-axially aligned combined bearings and sealing members that serve to rotatably support a power transmitting shaft that extends transversely through the circular interior of the housing. A first rotor plate is secured to the shaft and positioned in the interior in a centered position between the first and second side walls.

A number of co-axially aligned first ring shaped discs are disposed in the circular interior and in equal number on opposite sides of the circular rotor plate and are secured to the latter, with the first ring shaped discs defining a number of first passages therebetween that are of a first width. A number of co-axially aligned second ring shaped discs of substantially smaller diameter than the first discs are disposed therebetween to subdivide the inner portions of the first passages into second passages of a second width substantially less than that of the first widths. Both the first and second discs are rigidly supported from the first rotor plate.

The gaseous products of combustion flow from the ring shaped confined space in the housing through the converging spaces, throats, and diverging spaces substantially tangentially onto the outer periphery of the first discs, with the gaseous products of combustion flowing inwardly in the first passages in a spiral path to decrease from a first velocity and first pressure to a second velocity and second pressure, and in so doing imparting first rotational torque to the first discs by the frictional drag imposed on the portions of the first discs that define the first passages. The gaseous products of combustion enter the second passages at the second pressure to flow through the second passages in an inwardly directed spiral path with an initial third velocity that is greater than the second velocity and exiting at a fourth velocity to discharge through the centered openings in the first and second ring shaped discs that are in communication with the tubular discharge members. The increase in velocity of the gaseous products of combustion in flowing through the second passages is of the utmost importance, in that, the torque imparted to the rotor by such flow is proportinal to the square of the velocity of the products of combustion flowing through the passages.

The force transmitting shaft of the turbine is subjected to substantially no side thrust due to substantially equal quantities of gaseous products of combustion flowing inwardly in spiral paths on opposite sides of the centered first rotor plate. The power transmitting shaft has a power take off on one end that drives an electric generator at substantially constant speed to provide an alternating current output of a desired number of cycles per second. The rate of rotation of the rotor in the turbine is maintained at a constant speed by a throttling valve that regulates the rate of flow of gaseous products of combustion into the turbine. The valve member of the throttling valve is controlled by an electric motor that moved a valve member between an open and closed position in response to sensing means that detect changes in the rate of rotation of the rotor and sends signals to a servo loop that controls the electric motor on the throttling valve.

DESCRIPTION OF THE PREFERRED EMBODIMENT

Figure 1:
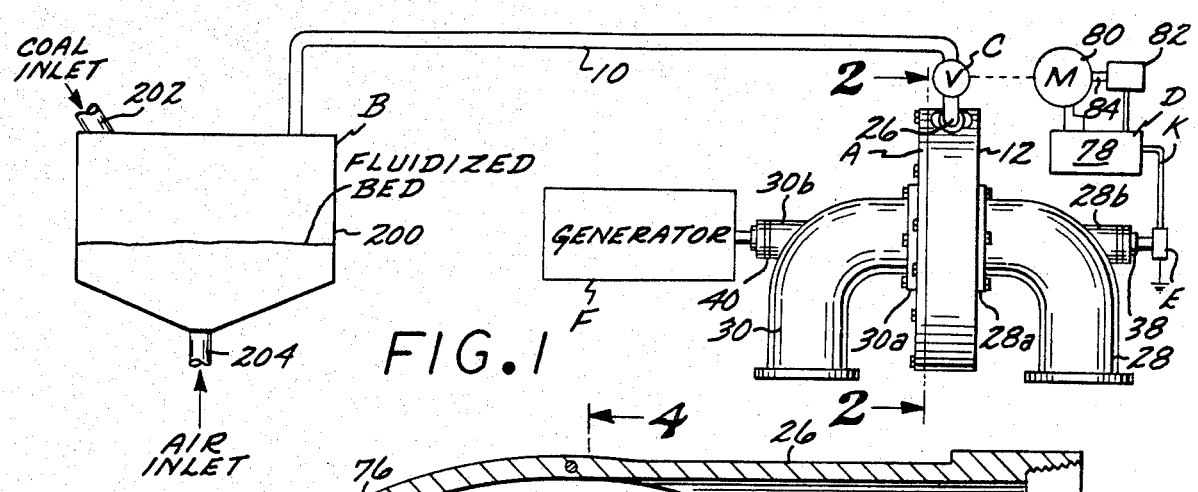
FIG. 1 is a diagrammatic view of the turbine, the closed loop speed control assembly for use therewith, and a fluidized bed of coal for supplying pressurized gaseous products of combustion for the operation of the turbine which is illustrated as driving an electrical generator.

The turbine A as best seen in FIG. 1 is operated by hot pressurized gaseous products of combustion that discharges to the turbine through a conduit 10 from an enclosed fluidized bed of coal B. The flow of pressurized gaseous products of combustion through the conduit 10 is controlled by an electric motor actuated throttling valve C that forms a part of a closed loop control box assembly D. An rpm sensing device E is operatively associated with the turbine A and continuously sends electric signals to the closed loop control box assembly D to indicate the rate at which the turbine A is operating. The electric motor actuated throttling valve C moves between an open and closed position in response to the closed loop control box assembly E to so vary the rate of flow of gaseous products of combustion to the turbine A that the latter operates at a constant speed. The turbine A is illustrated in FIG. 1 as driving an electric generator F.

Figure 4:
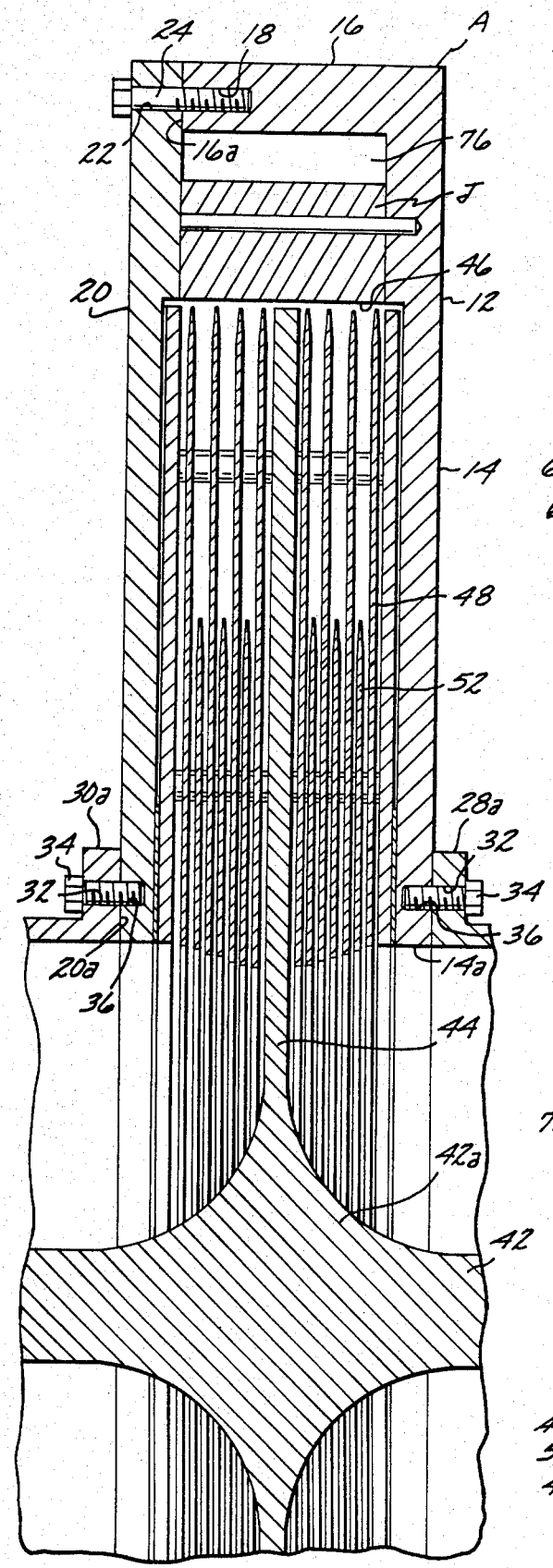
FIG. 4 is a transverse cross sectional view of an upper portion of the turbine taken on the line 4—4 of FIG. 2.

The turbine A has a housing 12 that includes a first side wall 14 that has a circular end wall 16 projecting outwardly therefrom, which end wall develops into a ring shaped surface 16*a* as may best be seen in FIG. 4. The ring shaped surface 16*a* has a number of circumferentially spaced tapped recesses 18 therein which are transversely aligned with transverse openings 22 formed in a second side wall 20. The second side wall is removably secured to the end wall by bolts 24 that extends through the openings 22 to engage the tapped recesses 18.

The housing 12 as may best be seen in FIG. 4 has centered first and second openings 14*a* and 20*a* defined in the first and second side walls 14 and 20. The end wall 16 as best seen in FIG. 1 has a tubular inlet 26 positioned in the upper portion thereof and tangential thereto through which the gaseous products of combustion flow into the interior of the housing 12 from the fluidized bed of coal B through the conduit 10.

The turbine A includes first and second 90° tubular discharge members 28 and 30 as shown in FIGS. 1 and 4, which members include first and second flanges 28*a* and 30*a*. The flanges 28*a* and 30*a* have a number of circumferentially spaced transverse bores 32 therein through which bolts 34 extend to engage circumferentially spaced tapped recesses 36 formed in the first and second side walls 14 and 20.

The tubular discharge members 28 and 30 have tubular bosses 28*b* and 30*b* extending outwardly therefrom in opposite directions as shown in FIG. 1, which bosses support first and second combined bearing and sealing assemblies 38 and 40. The turbine A includes a power output shaft 42 of the structure shown in FIG. 4. Shaft 42 includes an outwardly curved center portion 42*a* that develops into a heavy, thick walled, outwardly extending first circular rotor plate 44. The shaft 42 is rotatably supported in the bearing and sealing assembly 28*b* and 30*b*, with the first rotor plate occupying a centered position within the interior 46 of housing 12. A number of first ring shaped rotor discs 48 are provided as shown in FIGS. 4 and 5 that cooperate to define first passages 50 therebetween, and the discs being disposed in equal number on opposite sides of the first rotor plate 44.

A number of second ring shaped rotor discs 52 are provided that are of substantially smaller external diameter than the first ring shaped rotor discs 48. The second ring shaped discs are disposed between the first ring shaped rotor discs and cooperate therewith to define second passages 54 that are each of a substantially lesser width than each of the first passages 50 for reasons that will be explained later.

Figure 5:
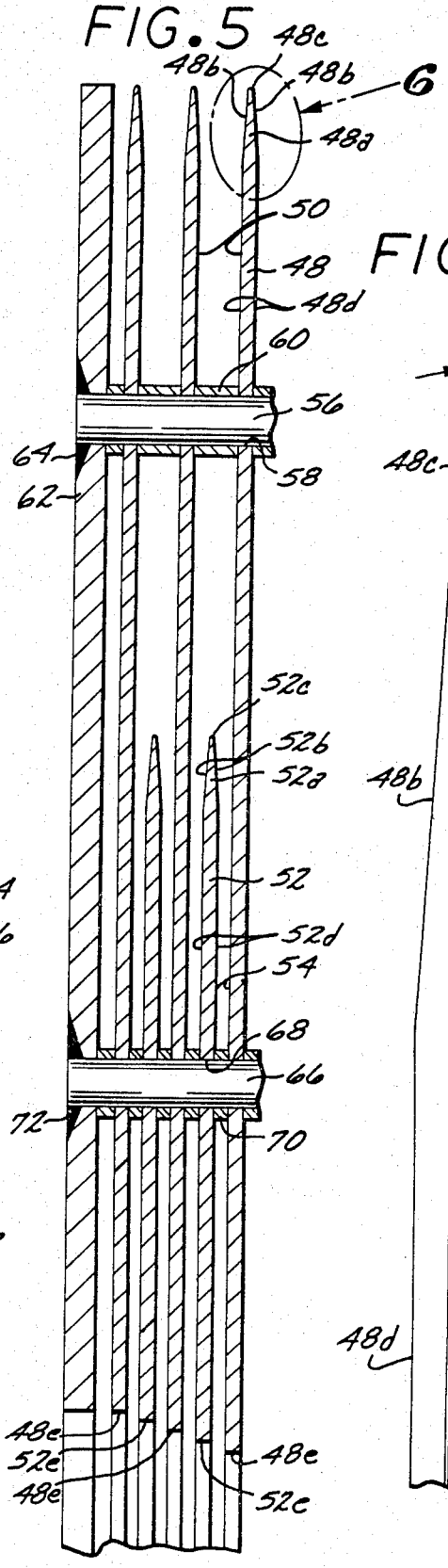
FIG. 5 is an enlarged transverse cross sectional view of first and second ring shaped discs that are laterally spaced to define first and second passages through which the gaseous products of combustion flow in inwardly directed radial paths to subject the turbine rotor to frictional drag to drive the same.

The first rotor plate 44 as may be seen in both FIGS. 4 and 5 supports on the outer portion a number of circumferentially spaced, transverse first rods 56 that extend through opening 58 in the first ring shaped discs 48, with the first ring shaped discs 48 being maintained in desired lateral spacing by first tubular spacers 60 of a high temperature resistant material mounted on the first rods 56 as shown in FIG. 5. A pair of ring shaped second rotor plates 62 are provided and secured to the outer ends of the first rods 56 by welds 64 as shown in FIG. 5. The second rotor plates are formed from a high temperature resistant metal or alloy of several metals.

The first rotor plate 44 also supports a number of transverse, circumferentially spaced second rods 66 as shown in FIG. 5 that extends through second transverse openings 68 in the second ring shaped discs 52. The second ring shaped discs 52 are held in a desired spacing on the second rods 66 by second tubular spacers 70, with the ends of the second rods 66 being secured to the second rotor plates by welds 72.

A number of elongate nozzle bodies J are provided and are disposed in overlapping relationship within the circular interior 46 adjacent the end walls 16, with each nozzle body preferably being formed from a plate of steel or other high temperature resisting material. The nozzle bodies J are of the same general structure as those described in my prior Pat. No. 4,232,992 entitled Geothermal Turbine and Method of Using Same that issued on Nov. 11, 1980.

Figure 3:
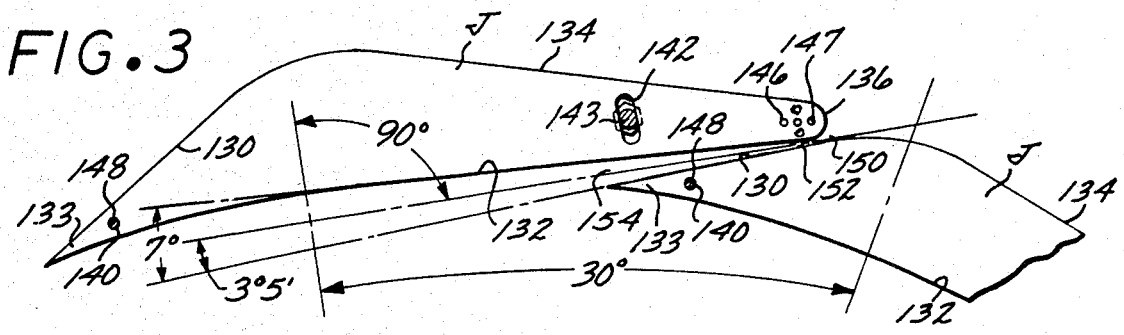
FIG. 3 is an enlarged side elevational view of a pair of elongate adjustable nozzle members that define an orifice therebetween.

Each of the nozzle bodies J as may be seen in FIG. 3 includes a forward edge surface 130, bottom edge surface 132, top edge surface 134, rear edge surface 136, and the forward and bottom edge surfaces merging to define an apex 133. The bottom edge surface 132 adjacent the apex 133 is slightly concave. Each of the nozzle bodies J adjacent the apex 133 thereof has a transverse bore 140 formed therein and the nozzle body also having a transverse slot 142 therein. A number of pins 148 extend transversely between the first and second side walls 14 and 20, with the pins 148 engaging the bores 140 and serving to pivotally support the nozzle bodies J.

Figure 2:
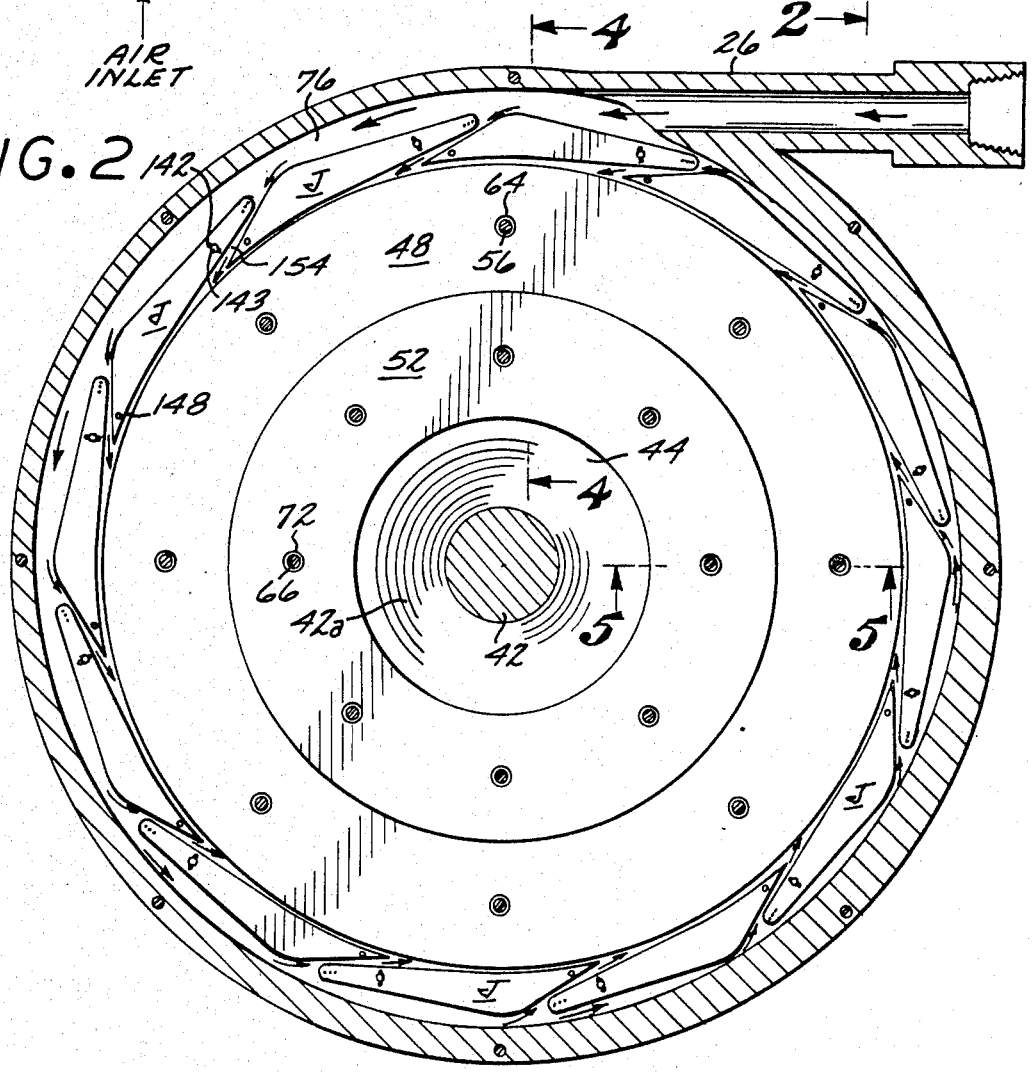
FIG. 2 is a cross sectional view of the turbine taken on the line 2—2 of FIG. 1.

Each of the nozzle bodies J has the transverse slot 142 therein engaged by an elongate member 143, such as a bolt, that extends between the first and second side walls 14 and 20. The length of the slots 142 limit the degree to which the nozzle bodies J may be pivoted on the pins 148 associated therewith within the limits illustrated in FIG. 3. Each of the nozzle bodies J adjacent the rearward edge surface 136 has a number of spaced apertures 146 therein, any one of which may be aligned with a transverse opening in one of the first or second side walls 14 and 20 to be engaged by a dowel pin 147 that serves to hold the nozzle body J in a desired adjusted angular position. In FIG. 3 it will be seen that each pair of nozzle bodies J cooperate to define a converging space 150, throat 152, and diverging space 154 through which the pressurized gaseous products of combustion flow inwardly from a space 76. The nozzle bodies J are indicated in FIG. 3 as on 30° spacings. The converging spaces 150 are in communication with a ring shaped confined space 76 defined between the nozzle bodies J and the end wall 16 as shown in FIG. 2. The pressurized gaseous products of combustion discharge from inlet 26 into space 76 to thereafter flow inwardly through the pairs of circumferentially spaced nozzle bodies J.

The rpm sensing device E may be a variable reluctance pickup which senses a discontinuity on the power output shaft 42, such as a small hole or a protruding pin (not shown). The sensing device E sends an rpm signal to a solid state closed loop control box 78. The control box 78 sends an "open" or "closed" signal to the throttling valve control motor 80. The valve C upon receiving a signal has the valve members (not shown) thereof move towards an open or closed position depending on the change in the rpm of the power output shaft 42. A potentiometer 82 on the valve control motor shaft 84 then sends a signal back to the solid state control box 78 that the valve C has in effect either opened or closed as required thereby closing the loop. The components of the assembly D are connected by an electric circuit K of conventional design, and accordingly the circuit will not be described in detail, nor is the connection to a source of electric power shown. It is highly desirable that the turbine A operate at a predetermined constant speed for the generator F is preferably an A.C. alternator that produces alternating current at a 60 cycle output which requires the generator to be driven at a constant 3,600 r.p.m.

The gaseous products of combustion after entering the ring shaped confined space 76 discharge therefrom continuously between the pairs of nozzle bodies J onto the outer peripheries of the first discs 48 and substantially tangential thereto. The nozzle bodies J as shown in FIG. 3 are preferably spaced 30° apart and adjustable within the 7° range shown.

The pairs of nozzle bodies J cooperate to direct inwardly flowing streams of pressurized gaseous products of combustion from the diverging spaces 154 substantially tangentially onto the first ring shaped discs 48, with the gaseous products of combustion entering the first passages 50 at a first velocity and exiting therefrom at a second lesser velocity. The gaseous products of combustion after exiting from the first passages flow through the second passages 54 to discharge through the tubular discharge members 28 and 30. Inasmuch as the quantity of the gaseous products of combustions flowing into the confined space 76 must equal the quantity of gaseous products of combustion flowing outwardly through the tubular discharge members 28 and 30, it will be apparent that the velocity of the gaseous products of combustion flowing through the second passages 54 due to their widths must be higher than through the first passages 50. This increase in velocity is of the upmost importance, as the frictional boundary layer drag imposed on the first and second ring shaped discs 48 and 52 to rotate the shaft 46 is proportional to the square of the velocity of the gaseous products of combustion in flowing through the first and second passages 50 and 54. Thus, it will be seen that the structure above described, in effect, results in a two step turbine, with the first step being that at which the gaseous products of combustion flow through the first passages 50, and the second step that at which the gaseous products of combustion flow through the second passages 54 at an increased velocity due to the narrow width of the second passages relative to that of the first passages.

The source of the pressurized gaseous products of combustion is the fluidized bed of coal B or combustion can that includes a high temperature, pressure resistant enclosure 200 into the interior of which coal is delivered through a suitable inlet 202, and the burning of the coal being effected by the discharge of pressurized air into the enclosed through an inlet 204. The pressurized gaseous products of combustion that discharge through the conduit 10 will normally contain fly ash.

This fly ash has in the past precluded pressurized gaseous products of combustion from a fluidized bed of coal being used to power conventional bladed turbines, due to the fly ash accumulating on the interior of the housing and impinging on the blades of the turbine, rendering it unworkable or at best, operate at a low efficiency.

The first and second ring shaped discs 48 and 52 are of the same structure, and differ from one another only in that the first ring shaped discs have an external diameter substantially greater than those of the second ring shaped discs.

Inasmuch as the first and second ring shaped discs 48 and 52 are of the same structure only the structure of the first disc will be described in detail. Both the first and second ring shaped discs can be formed from a high temperature resistant material, such as hot pressed silicon nitride.

Figure 6:
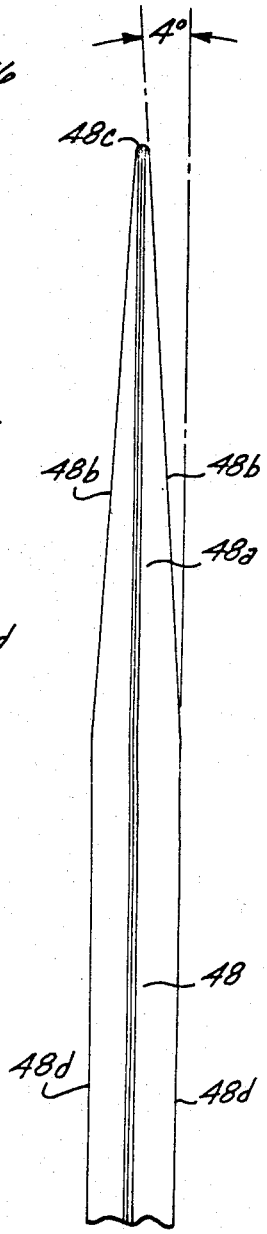
FIG. 6 is a fragmentary transverse cross sectional view of an outer portion of one of the ring shaped discs that is of substantially constant strength.

Each of the first ring shaped discs 48 as best seen in FIGS. 5 and 6 has an outer circumferential portion of elongate triangular transverse cross section 48*a* that is defined between a pair of inwardly tapering side wall sections 48*b* that merge at their outer ends in a rounded apex 48*c*. Each side wall section 48*b* is at an angle of substantially 4 degrees with the side wall section 48*d* situated inwardly therefrom. The side wall sections 48*d* are parallel to one another. The inner portion of the ring shaped disc between the side wall sections 48*d* terminates in a circumferentially extending edge 48*e* as best seen in FIG. 5.

The configuration of the outer portion 48*a* provides two operational advantages. First, the outer portion 48*a* is of uniform strength in resisting the centrifugal force imposed thereon as the first ring shaped discs rotate at high speed. The second operational advantage is that particles of fly ash (not shown) entrained with the gaseous products of combustion flowing through the passages 50 are deflected by the wall sections 48*b* back into the passage to ultimately discharge from the turbine A with the gaseous products of combustion. Thus, there is no tendency for the particles of fly ash to clog the turbine A or impair the efficiency with which it operates. The particles of fly ash have no appreciable abrading action of either the first or second ring shaped discs 48 and 52 as the particles of fly ash and the discs are moving rotationably at substantially the same velocity and the boundary layer of gaseous products of combustion that adheres to the surfaces of the discs 48 and 52 even when they are rotating at maximum speed prevents the fly ash from even touching the discs.

Each second ring shaped blade 52 has an outer portion 52*a* defined between inwardly tapering side wall sections 52*b* that merge into an apex 52*c*, and the side wall sections 52*b* being situated outwardly from side wall sections 52*d*. The first and second ring shaped discs 48 and 52 have inner circumferential edges 48*e* and 52*e* respectively as shown in FIG. 5.

The source of pressurized air for operation of the fluidized bed of coal B may be from any desired source, such as a compressor (not shown) that may be driven concurrently by turbine A with electrical generator F.

The use and operation of the invention has been explained previously in detail and need not be repeated.

What is claimed is:

1. In combination with a source of pressurized gaseous products of combustion resulting from the burning of coal and that contains fly ash, a turbine that includes a housing that has a pair of laterally spaced side walls connected by an end wall, which end wall has an inlet therein through which a stream of said pressurized gaseous products of combustion flow to the interior of said housing; nozzle means in said interior adjacent said end wall that subdivide said gaseous products of combustion in said interior into a plurality of circumferentially spaced inwardly directed pressurized streams thereof; a centered power take off shaft that transversely spans said interior and is rotatably supported from said housing; a rotor mounted on said power take off shaft and occupying a centered position in said interior, with both of said side walls having centered outlets therein through which said gaseous products of combustion flow, said turbine being characterized by said rotor delivering rotational power to said power take off shaft to two stages, by means of "boundary layer drag" said rotor including:

a. a first circular rotor plate secured to said power output shaft and occupying a centered position in said interior;

b. a plurality of laterally spaced first ring shaped discs disposed on opposite sides of said first rotor plate in equal number within said interior, said first ring shaped discs defining a plurality of first passages of a first width therebetween;

c. a plurality of laterally spaced second ring shaped discs of substantially smaller external diameter than that of said first ring shaped discs and situated between the latter in equal number on opposite sides of said first rotor plate, said second ring shaped discs cooperating with said first ring shaped discs to define a plurality of second passages of a second width, said pressurized streams of gaseous products of combustion entering said first passages substantially tangentially thereto at a first velocity and first pressure to flow inwardly in a spiral path through said first passages to impart first stage rotational power to said power take off shaft due to the boundary layer drag imposed on said first ring shaped discs, said gaseous products of combustion exiting from said first passages at a second pressure and second velocity, said gaseous products of combustion entering said second passages at said second velocity and second pressure to thereafter flow therethrough in an inwardly directed spiral path to discharge through said centered outlets and in so doing imparting second stage rotational power to said power take off shaft due to boundary layer drag imposed on said second ring shaped blades and portions of said first ring shaped blades adjacent thereto, with the velocity of flow of said gaseous products of combustion through said second passages being at least partially at a third velocity greater than said second velocity due to said second passages being of said second width that is substantially less than said first width, and said power take off shaft being subjected to substantially no side thrust due to said gaseous products of combustion flowing through an equal number of said first and second passages on opposite sides of said first rotor plate; and d. first means for maintaining said first and second ring shaped discs at fixed positions relative said first circular rotor plate, with said second width being greater than the maximum overall dimension of a particle of fly ash to permit said fly ash to discharge freely through said first and second passages to said centered outlet with said first means including:

1. a plurality of first, circumferentially spaced rods supported by said first rotor plate and extending outwardly from opposite sides thereof to engage aligned openings in said first ring shaped discs;
2. a plurality of second, circumferentially spaced rods supported by said first rotor and inwardly disposed from said first rods a substantial distance, said second rods engaging aligned openings in said first and second ring shaped discs;
3. a plurality of first tubular spacers on said first rods that are in abutting contact with said first ring shaped discs and so maintain said first ring shaped discs relative to one another that said first passages of first width are provided therebetween;
4. a plurality of second tubular spacers on said second rods that are in abutting contact with said first and second ring shaped discs and so maintain said first and second ring shaped discs relative to one another that said second passages of said second width are defined therebetween; and
5. a pair of second rotor plates of ring shape that are secured to opposite ends of said first and second rods to maintain said first and second ring shaped discs in fixed positions relative said first rotor plate.

2. A turbine as defined in claim 1 in which each of said first ring shaped discs includes an inner and an outer portion, said outer portion being of constant strength and defined between a pair of first side walls that taper inwardly towards one another to merge into a circumferentially extending apex, and each of said first side walls defining said outer portion of equal strength serving also to deflect particles of fly ash entrained with said streams of gaseous products that may contact them back into said first passages to thereafter flow through said second passages to discharge through said centered opening.

3. A turbine as defined in claim 2 in which each of said first side walls is at an angle of substantially four degrees relative to a second side wall that partially defines said central portion.

4. A turbine as defined in claim 1 in which each of said centered openings has a transverse cross sectional area substantially greater than that of said inlet to minimize the build up of a back pressure on said gaseous products of combustion in said interior prior to said gaseous products of combustion discharging through said centered openings.

5. A turbine as defined in claim 4 which in addition includes:

e. a pair of oppositely disposed ninety degree tubular discharge members in abutting contact with opposite sides of said housing and in communication with said centered outlets, said pair of tubular discharge members having said gaseous products of combustion flow therethrough from said interior of said housing;
f. a pair of oppositely extending, coaxially aligned bosses supported from said pair of discharge members; and
g. bearing and sealing means operatively associated with said pair of bosses to rotatably support end portions of said power take off shaft.

6. A turbine as defined in claim 1 which in addition includes:

e. an electric motor actuated throttling valve through which said pressurized gaseous products of combustion flow prior to entering said inlet;
f. an electric circuit for energizing said electric motor actuated throttling valve;
g. second means for detecting and signaling changes in the rate of rotation of said power take off shaft; and
h. third means responsive to signals from said second means for so controlling said electric circuit that said throttling valve is actuated to regulate the flow of said pressurized gaseous products of combustion to said turbine at such a rate that said power take off shaft is driven at a substantially constant predetermined velocity.

7. A turbine as defined in claim 6 that in addition includes:

i. an electric generator driven by said power take off shaft, said generator producing alternating current of a desired number of cycles per second when rotated at said constant predetermined velocity.

* * * * *